US007664446B2

(12) United States Patent
Oyama

(10) Patent No.: US 7,664,446 B2
(45) Date of Patent: Feb. 16, 2010

(54) IMAGE FORMING APPARATUS AND A FIXING DEVICE HAVING A RIGID HEAT-INSULATING LAYER

(75) Inventor: Hajime Oyama, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 1266 days.

(21) Appl. No.: 10/438,938

(22) Filed: May 16, 2003

(65) Prior Publication Data

US 2004/0005177 A1 Jan. 8, 2004

(30) Foreign Application Priority Data

May 17, 2002 (JP) ..... 2002-142725
Mar. 20, 2003 (JP) ..... 2003-078269

(51) Int. Cl.
*G03G 15/20* (2006.01)

(52) U.S. Cl. ..... 399/328

(58) Field of Classification Search ..... 399/328, 399/333, 320, 330
See application file for complete search history.

(56) References Cited

U.S. PATENT DOCUMENTS 4,406,536 A 9/1983 Suzuki et al.
4,724,305 A * 2/1988 Iimura et al. ..... 219/469
4,745,431 A * 5/1988 Kogure et al. ..... 399/69
4,760,427 A 7/1988 Oyama et al.
4,989,043 A 1/1991 Suzuki et al.
5,083,160 A 1/1992 Suzuki et al.
5,182,600 A 1/1993 Hasegawa et al.
5,198,861 A 3/1993 Hasegawa et al.
5,270,777 A * 12/1993 Yoshida et al. ..... 399/333
5,349,423 A * 9/1994 Nagato et al. ..... 399/122
5,450,177 A 9/1995 Oyama
5,579,097 A * 11/1996 Tomoe et al. ..... 399/323
5,612,774 A * 3/1997 Kinoshita ..... 399/331
5,655,200 A 8/1997 Oyama
5,659,860 A 8/1997 Sasaki et al.
5,724,638 A * 3/1998 Isogai et al. ..... 399/333
5,758,241 A 5/1998 Oyama et al.
5,771,426 A 6/1998 Oka et al.
5,771,429 A 6/1998 Oyama et al.
5,805,965 A 9/1998 Tsuda et al.

(Continued)

FOREIGN PATENT DOCUMENTS

JP 57-155570 9/1982

(Continued)

OTHER PUBLICATIONS

U.S. Appl. No. 09/960,922, filed Sep. 25, 2001, Aoki et al.

(Continued)

*Primary Examiner*—Quana M Grainger
(74) *Attorney, Agent, or Firm*—Oblon, Spivak, McClelland, Maier & Neustadt, L.L.P.

(57) ABSTRACT

A fixing device for fixing a toner image on a sheet with heat while conveying the sheet of the present invention includes a heat roller or rotatable heating member and a press roller or rotatable pressing member. The heat roller includes a heat-generating layer and a rigid heat-insulting layer positioned inward of the heat-generating layer. The press roller conveys the sheet by nipping it in cooperation with the heat roller.

26 Claims, 6 Drawing Sheets

U.S. PATENT DOCUMENTS

| | | | | | |
|---|---|---|---|---|---|
| 5,822,664 | A | | 10/1998 | Oka et al. | |
| 5,864,733 | A | | 1/1999 | Mae et al. | |
| 5,915,147 | A | * | 6/1999 | Kouno et al. | 399/69 |
| 5,953,568 | A | | 9/1999 | Fujishiro et al. | |
| 6,108,906 | A | * | 8/2000 | Fujita et al. | 29/895.211 |
| 6,122,479 | A | * | 9/2000 | Fujita et al. | 399/333 |
| 6,137,087 | A | * | 10/2000 | Tomatsu | 219/216 |
| 6,321,061 | B1 | * | 11/2001 | Sonobe et al. | 399/329 |
| 6,445,902 | B1 | * | 9/2002 | Hirst et al. | 399/328 |
| 6,463,244 | B2 | | 10/2002 | Aoki et al. | |
| 6,505,014 | B2 | | 1/2003 | Aoki et al. | |
| 6,526,248 | B1 | | 2/2003 | Aoki et al. | |
| 6,643,490 | B2 | * | 11/2003 | Regimbal | 399/329 |
| 6,650,863 | B2 | * | 11/2003 | Fuma | 399/329 |
| 7,054,589 | B2 | * | 5/2006 | Okayasu et al. | 399/329 |
| 7,127,202 | B2 | * | 10/2006 | Fujita et al. | 399/307 |
| 2002/0015602 | A1 | * | 2/2002 | Mochimaru et al. | 399/309 |
| 2002/0114639 | A1 | * | 8/2002 | Lee et al. | 399/90 |
| 2002/0146255 | A1 | * | 10/2002 | Kishimoto et al. | 399/69 |
| 2003/0002895 | A1 | * | 1/2003 | Kato et al. | 399/333 |
| 2003/0015309 | A1 | * | 1/2003 | Bouchard et al. | 164/480 |
| 2003/0031485 | A1 | * | 2/2003 | Marsh | 399/341 |
| 2003/0086735 | A1 | * | 5/2003 | Payne et al. | 399/328 |
| 2003/0147680 | A1 | * | 8/2003 | Kawamura et al. | 399/329 |
| 2004/0105708 | A1 | * | 6/2004 | Imai et al. | 399/330 |

FOREIGN PATENT DOCUMENTS

| | | | | |
|---|---|---|---|---|
| JP | 59-015960 | | | 1/1984 |
| JP | 59-184384 | | | 10/1984 |
| JP | 63-082268 | | | 4/1988 |
| JP | 01017079 | A | * | 1/1989 |
| JP | 01198773 | A | * | 8/1989 |
| JP | 02131276 | A | * | 5/1990 |
| JP | 02137874 | A | * | 5/1990 |
| JP | 02173779 | A | * | 7/1990 |
| JP | 06-016306 | | | 1/1994 |
| JP | 07199700 | A | * | 8/1995 |
| JP | 08-155783 | | | 6/1996 |
| JP | 9-22208 | | | 1/1997 |
| JP | 10133498 | A | * | 5/1998 |
| JP | 10166508 | A | * | 6/1998 |
| JP | 10254263 | A | * | 9/1998 |
| JP | 11-167299 | | | 6/1999 |
| JP | 11167299 | A | * | 6/1999 |
| JP | 11219778 | A | * | 8/1999 |
| JP | 2000-29328 | | | 1/2000 |
| JP | 2000-29342 | | | 1/2000 |
| JP | 2000-206814 | | | 7/2000 |
| JP | 2000-221824 | | | 8/2000 |
| JP | 2000-347524 | | | 12/2000 |
| JP | 2001-5315 | | | 1/2001 |
| JP | 2001-32825 | | | 2/2001 |
| JP | 2001-066928 | | | 3/2001 |
| JP | 2001-265147 | | | 9/2001 |
| JP | 2001-343850 | | | 12/2001 |
| JP | 2002-40855 | | | 2/2002 |
| JP | 2002132073 | A | * | 5/2002 |
| JP | 2003145626 | A | * | 5/2003 |

OTHER PUBLICATIONS

U.S. Appl. No. 10/050,955, filed Jan. 22, 2002, Aoki et al.
U.S. Appl. No. 10/158,852, filed Jun. 3, 2002, Kikuchi et al.
U.S. Appl. No. 10/188,756, filed Jul. 5, 2002, Oyama et al.
U.S. Appl. No. 10/306,082, filed Nov. 29, 2002, Yura et al.
U.S. Appl. No. 10/634,900, filed Aug. 6, 2003, Atsushi et al.
U.S. Appl. No. 10/734,292, filed Dec. 15, 2003, Takeuchi et al.
U.S. Appl. No. 10/875,316, filed Jun. 25, 2004, Takayuki et al.
U.S. Appl. No. 10/872,438, filed Jun. 22, 2004, Takeuchi et al.

* cited by examiner

IMAGE FORMING APPARATUS AND A FIXING DEVICE HAVING A RIGID HEAT-INSULATING LAYER

BACKGROUND OF THE INVENTION

1. Field of the Invention

The present invention relates to a copier, printer, facsimile apparatus or similar electrophotographic image forming apparatus for printing images on papers, OHP (OverHead Projector) films or similar sheets. More particularly, the present invention relates to a fixing device arranged in such an image forming apparatus and including a heat roller or similar rotatable heating member and a press roller or similar rotatable pressing member configured to fix an image formed on a sheet with heat and pressure while conveying the sheet in cooperation.

2. Description of the Background Art

An electrophotographic image forming apparatus including a fixing device of the type described is conventional. In this type of fixing device, if heat generated by a heat roller or similar rotary heat-generating member leaks, then not only energy necessary for fixation and therefore cost increases, but also the warm-up time of the fixing device increases. Further, heat leaked from the heat roller heats members other than the fixing device to thereby bring about toner filming, adhesion, deterioration of a developer and other problems.

In light of the above, Japanese Patent Laid-Open Publication No. 2000-221824, for example, discloses an image forming apparatus including a fixing device in which a heat-resistant elastic layer is formed on the metallic core of a press roller. This elastic layer has thermal conductivity of 0.1 W/m·k or below. The problem with the above fixing device is that because heat insulation is degraded by the compressive deformation of the elastic layer, the elastic layer must be provided with certain thickness, resulting in an increase in roller diameter and therefore in the overall size of the fixing device.

On the other hand, Japanese Patent Laid-Open Publication No. 2000-29342, for example, teaches a fixing device in which ribs are formed on the inner periphery of a press roller in order to reduce the wall thickness and therefore thermal capacity of the heat roller, thereby accelerating the warm-up of the fixing device. The thin heat roller, however, gives rise to another problem that pressure for fixation cannot be made high enough to meet the increasing demand for high-speed fixation.

In a conventional fixing device configured to implement high-speed fixation, a heat-generating layer is formed on a heat roller for reducing a roller diameter. In addition, a metallic core is positioned inward of the heat-generating layer in order to protect the heat-generating layer from deformation even when pressure for fixation is increased. The metallic core, however, absorbs heat output from the heat-generating layer and thereby slows down the temperature elevation of the heat-generating layer. This again brings about the various problems ascribable to the leak of heat stated earlier.

Technologies relating to the present invention are also disclosed in, e.g., Japanese Patent Laid-Open Publication Nos. 9-22208 and 11-162299 and Japanese Patent Laid-Open Publication Nos. 2000-29328, 2000-347524, 2001-5315, 2001-32825 and 2002-40855.

SUMMARY OF THE INVENTION

It is an object of the present invention to promote, in a fixing device of the type including a heat roller formed with a heat-generating layer, efficient use of heat by obviating heat radiation while protecting the heat-generating layer from deformation, and to accelerate the temperature elevation of the heat-generating layer.

It is another object of the present invention to insure, in a fixing device of the type described, a sufficient nip for fixation to thereby maintain pressure constant and therefore to obviate irregular fixation.

It is another object of the present invention to obviate, in a fixing device of the type described, irregular fixation for thereby realizing uniform, stable fixation.

It is another object of the present invention to obviate, in a fixing device of the type described, offset and defective separation of a sheet.

It is another object of the present invention to prevent, in a fixing device of the type described, the potential of a fixing roller for thereby protecting an image from disturbance ascribable to discharge before fixation.

It is another object of the present invention to effectively guarantee, in a fixing device of the type described, heat insulation while preserving rigidity.

It is another object of the present invention to implement, in a fixing device of the type described, space- and energy-saving fixation.

It is still another object of the present invention to reduce, in a fixing device of the type described, the thermal capacity of a rotatable heating member for thereby saving energy.

It is yet another object of the present invention to provide an image forming apparatus including a fixing device achieving the above advantages.

It is a further object of the present invention to effectively prevent, in an image forming apparatus of the type described, heat radiation toward an image carrier while preserving desirable image transfer.

A fixing device for fixing a toner image on a sheet with heat while conveying the sheet of the present invention includes a heat roller including a heat-generating layer and a rigid heat-insulting layer positioned inward of the heat-generating layer. A rotary pressing member is configured to convey the sheet by nipping it in cooperation with the heat roller.

An image forming apparatus including the above fixing device is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
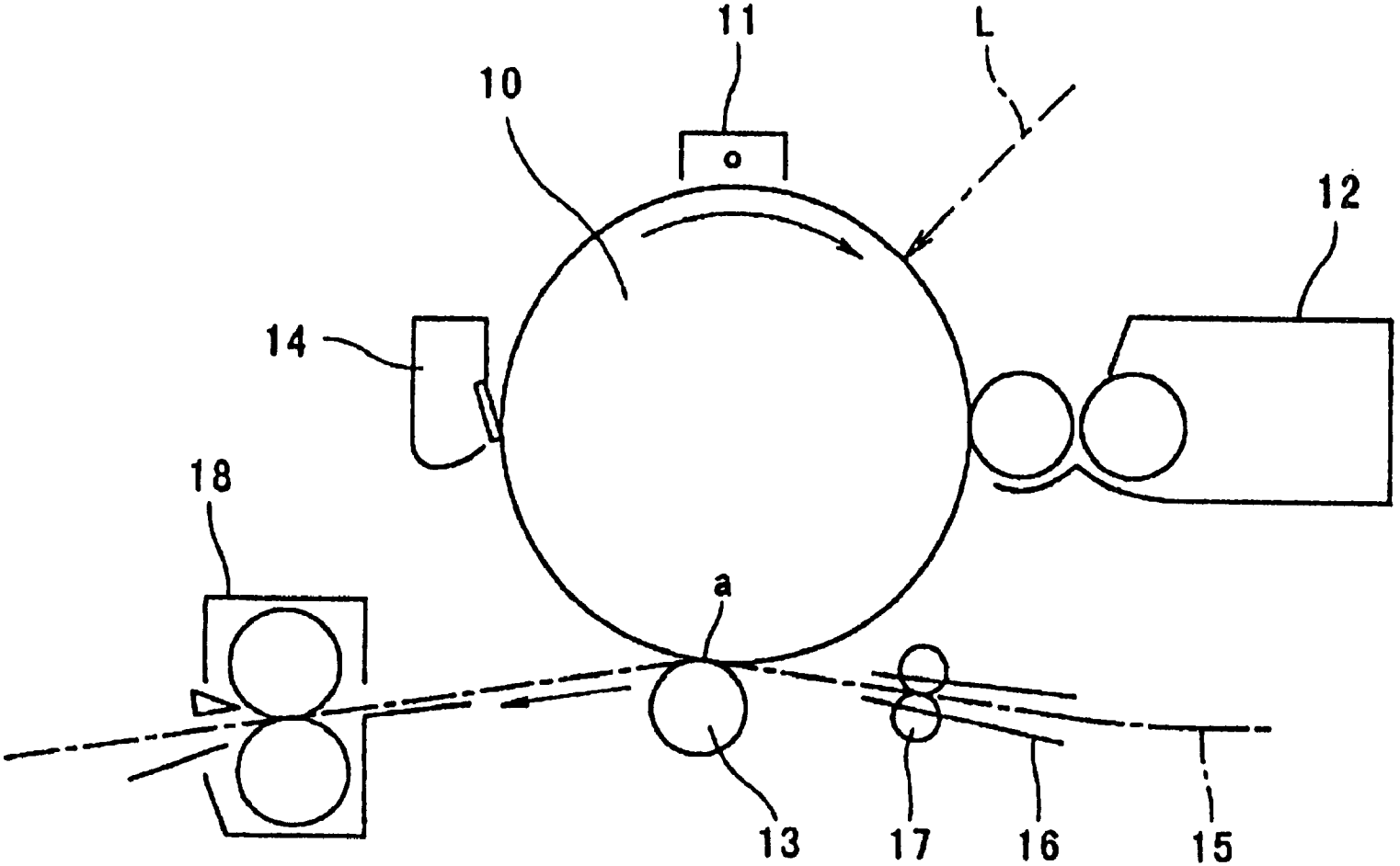
FIG. 1 is a view showing essential part of an electrophotographic image forming apparatus to which the present invention is applicable.

Referring to FIG. 1 of the drawings, essential part of an electrophotographic image forming apparatus is shown and includes a fixing device embodying the present invention. As shown, the image forming apparatus includes a photoconductive drum or image carrier 10. Arranged around the drum 10 are a charger 11, an exposing unit, not shown, a developing device 12, an image transferring device 13, a peeler, not shown, a cleaning device 14, and a quenching lamp not shown.

The charger 11 uniformly charges the surface of the drum 10. The exposing unit scans the charged surface of the drum 10 with a laser beam in accordance with image data to thereby form a latent image on the drum 10. The developing device 12 develops the latent image with toner for thereby producing a corresponding toner image. The image transferring device 13 applies a bias voltage at an image transfer position a to thereby transfer the toner image from the drum 10 to a sheet or recording medium. The peeler peels of the sheet from the surface of the drum 10 after the image transfer. The cleaning device 14 removes the toner left on the drum 10 after the image transfer. The quenching lamp removes potential left on the surface of the drum 10 after the image transfer.

A path 15 for conveying the sheet from the right to the left, as viewed in FIG. 1, extends below the drum 10 via the image transfer position a between the drum 10 and the image transferring device 13. A pair of guide plates 16 and a registration roller pair 17 are positioned on the path 15 upstream of the image transfer position a in the direction of sheet conveyance. The guide plates 16 guide the sheet being conveyed along the path 15 while the registration roller pair 17 once stops the sheet and then conveys it in synchronism with the rotation of the drum 10 carrying the toner image. A fixing device 18 is positioned downstream of the image transfer position a in the direction of sheet conveyance and configured to fix the toner image on the sheet with heat and pressure.

In operation, the charger 11 uniformly charges the surface of the drum 10 being rotated clockwise as viewed in FIG. 1. The exposing unit scans the charged surface of the drum 10 with a laser beam L in accordance with image data to thereby form a latent image. Subsequently, the developing device 12 develops the latent image with toner for thereby producing a corresponding toner image.

On the other hand, a sheet is fed from, e.g., a sheet cassette, not shown, to the path 15 and then conveyed along the path 15 toward the registration roller pair 17 while being guided by the guide plates 16. The registration roller pair 17 once stops the sheet and then starts conveying the sheet toward the image transfer position a such that the leading edge of the sheet meets the leading edge of the toner image formed on the drum 10.

When the sheet is brought to the image transfer position a, the image transferring device 13 applies a bias voltage for transferring the toner image from the drum 10 to the sheet. The sheet with the toner image is peeled off from the drum 10 by the peeler and then conveyed to the fixing device 18. The fixing device 18 fixes the toner image on the sheet with heat and pressure. Thereafter, the sheet with the thus fixed toner image is driven out of the apparatus to a tray not shown.

After the image transfer, the cleaning device 14 cleans the surface of the drum 10, i.e., removes the toner left on the drum 10 without being transferred to the sheet. Subsequently, the quenching lamp discharges the surface of the drum 10 to thereby prepare the drum 10 for the next image forming cycle.

Figure 2:
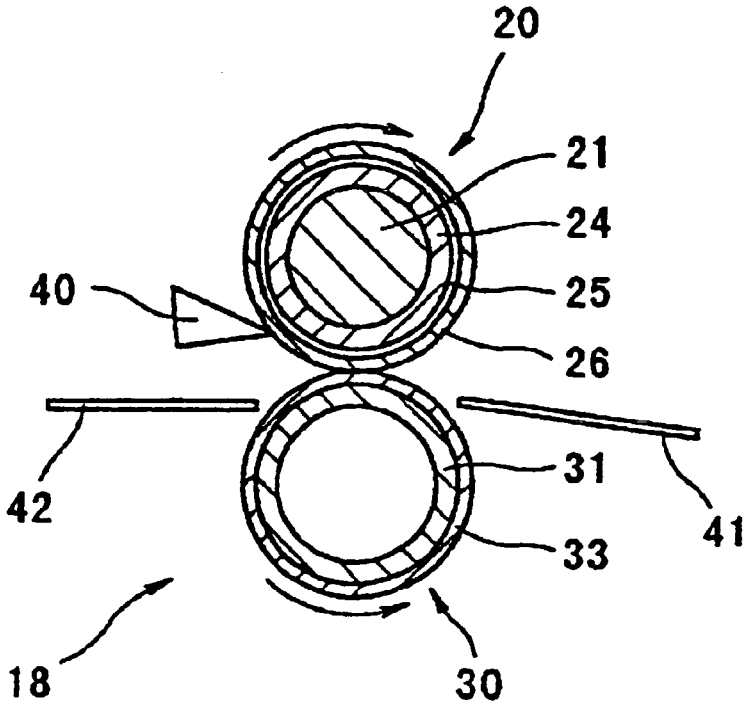
FIG. 2 shows a fixing device embodying the present invention.

FIG. 2 shows the fixing device 18 in detail. As shown, the fixing device 18 includes a heat roller 20 and a press roller 30 each being rotatable in a particular direction indicated by an arrow. The heat roller or rotatable heating member 20 and press roller or rotatable pressing member 30 in rotation convey the sheet while nipping it therebetween, cooperating to fix the toner image on the sheet with heat and pressure. The heat roller 20 includes a solid metallic core 21 on which a rigid heat-insulating layer 24 is formed. A planar heat-generating body 25 is wrapped around the heat-insulating layer 24 while a heating layer 26 is formed on the heating body 25. The heat-insulating layer 24 is therefore positioned inward of the planar heat-generating body or layer 25.

The core 21, positioned inward of the heat-insulating layer 24, is provided with rigidity by being formed of iron, stainless steel (SUS), aluminum (conventional), an alloy or similar metal. This prevents the core 21 from deforming when subject to pressure; otherwise, a fixing force or fixation would become irregular. The core 21 is more rigid than the rigid heat-insulating layer 24 although inferior in heat-insulating ability to the layer 24. The rigidity of the core 21 is of such a degree that deformation is allowed in accordance with pressure, and is dependent on the thermal property, grain size and amount of deposition of toner as well as on fixing speed and roller diameter. While the core 21 is shown and described as being solid, it may be a hollow cylinder. If desired, the core 21 may be omitted, in which case only the heat-insulating layer 24 will be positioned inward of the planar heat-generating body 25.

The rigid heat-insulating layer 24 is provided with hardness of 70 or more in JIS (Japanese Industrial Standards) A scale. Alternatively, the hardness may be such that when pressure of 1 $kg/cm^2$ to 5 $kg/cm^2$ is applied, the heat-insulating layer 24 deforms by not more than 10% in the direction in which the pressure is applied. Further, the thermal conductivity of the heat-insulating layer 24 is selected to be 0.1 W/m·k or below, as measured at the position and in the condition wherein the heat roller 20 and press roller 30 nip the sheet.

The planar heat-generating body 25 is implemented as plain weave of aramid fibers with carbon fibers dispersed therein or aramid fibers with stainless steel fibers mixed therewith. The heating layer 26 is formed of silicone rubber or similar material having heat resistance and parting ability.

On the other hand, the press roller 30 is made up of a hollow, cylindrical metallic core 31 and an elastic heat-insulating layer 33 formed on the core 31. The core 31, like the core 21, is formed of iron, stainless steel (SUS), aluminum, an alloy or similar metal. While the core 31 is shown as being a hollow cylinder whose wall is thick enough to withstand pressure, it may be solid, if desired. The elastic heat-insulating layer 33 is heat-insulating and has parting ability and elasticity and may be formed of silicone rubber by way of example. The rubber hardness of the heat-insulating layer 33 should preferably be between 25 degrees and 65 degrees in JIS A scale while the thickness of the layer 33 should preferably be several hundred to 2,000 μm.

The elastic heat insulating layer 33 of the press roller 30 may be replaced with a flexible layer formed on the core 31 with or without the intermediary of an elastic layer or a rigid layer. The flexible layer is implemented as, e.g., a thin film freely deformable and compressed little by pressure during operation. More specifically, the flexible layer may be a layer coated on the elastic layer, a tube covering the elastic layer or a film layer adhered to the elastic layer.

In the configuration described above, the planar heat-generating body 25 makes the heat roller 20 smaller in size than a halogen heater or similar heat source. Further, the rigid heat-insulating layer 24, positioned inward of the heat-generating body 25, obviates heat radiation, i.e., prevents the heat of the heat-generating body 25 from being transferred to the inside of the heat roller 20, thereby allowing the heat to be efficiently used. This not only promotes energy saving, but also accelerates the temperature elevation of the heat-generating body 25 to thereby reduce the warm-up time of the fixing device 18. In addition, members other than the fixing device 18 are protected from heat elevation, so that toner filming and adhesion are obviated while a developer is prevented from being deteriorated.

Further, the rigid heat-insulating layer 24, positioned inward of the heat-generating body 25, prevents the heat-generating body 25 from deforming and is therefore free from the fall of heat-insulating ability itself. Because the heat-insulating layer 24 is thin, not only the diameter of the heat roller 20 and therefore the overall size of the fixing device 18 is reduced, but also the thermal capacity of the heat roller 20 is reduced to reduce the warm-up time of the fixing device 18. In this manner, the heat-insulating layer 24 promotes efficient use of heat while preventing the heat-generating body 25 from deforming. This, coupled with high rigidity, allows the heat roller 20 to be rotated at high speed for realizing high-speed fixation.

Moreover, the rigid heat-insulating layer 24 of the heat roller 20 and the elastic layer 33 or flexible layer of the press roller 30 cooperate to enhance close contact of the two rollers 20 and 30 and insure a sufficient nip while maintaining pressure acting therebetween constant.

In the fixing device 18 shown in FIG. 2, a peeler 40 is positioned to peel off the sheet moved away from the nip between the heat roller 20 and the press roller 30 while guiding the sheet. An upstream guide plate 41 is positioned upstream of the two rollers 20 and 30 for guiding the sheet to the nip between the rollers 20 and 30. Also, a downstream guide plate 42 is positioned downstream of the rollers 20 and 30 for guiding the sheet toward an outlet not shown.

Figure 3:
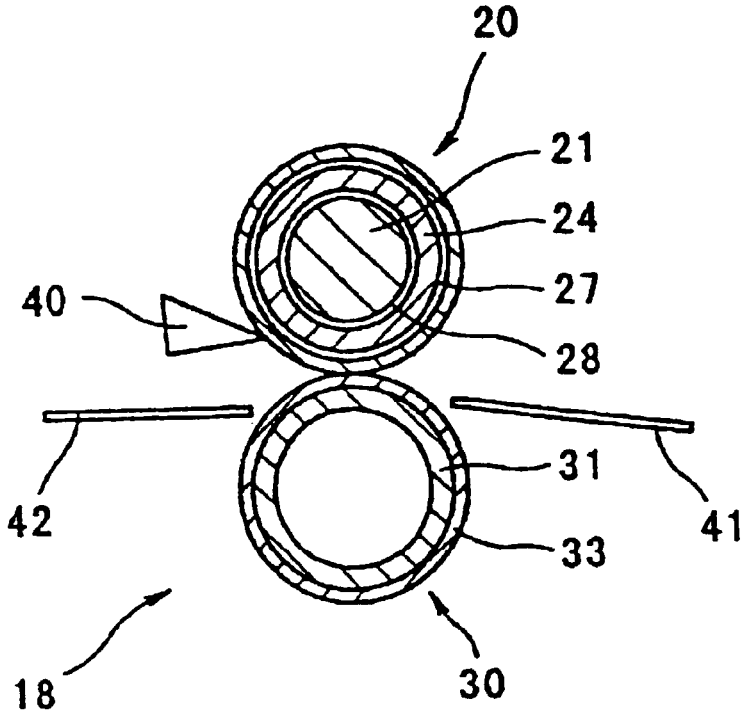
FIG. 3 shows a modified form of a heat-generating body included in the illustrative embodiment.

FIG. 3 shows a modification of the heat-generating body included in the fixing device 18 of FIG. 2. As shown, the planar heat-generating body 25, FIG. 2, is replaced with an electromagnetic induction heat-generating body 27. An electromagnetic induction coil 28 is positioned inward of the heat-generating body 27 with the intermediary of the rigid heat-insulating layer 24. The heat-generating body 27 is implemented as a sheet of iron, SUS, Ni, Cu, Cr, Co or similar material capable of generating eddy current. In FIG. 3, structural elements identical with the structural elements shown in FIG. 2 are designated by identical reference numerals and will not be described specifically in order to avoid redundancy.

Figure 8:
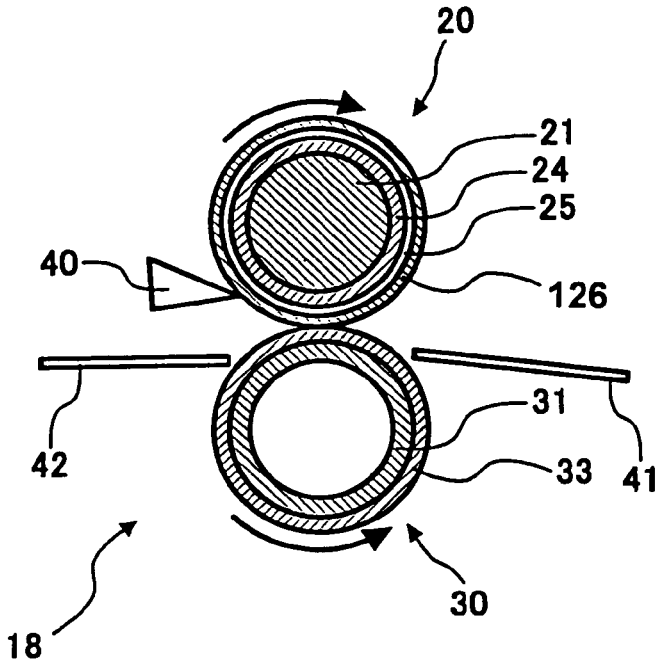
FIG. 8 shows a fixing device of the present invention in a further alternative embodiment.
Figure 9:
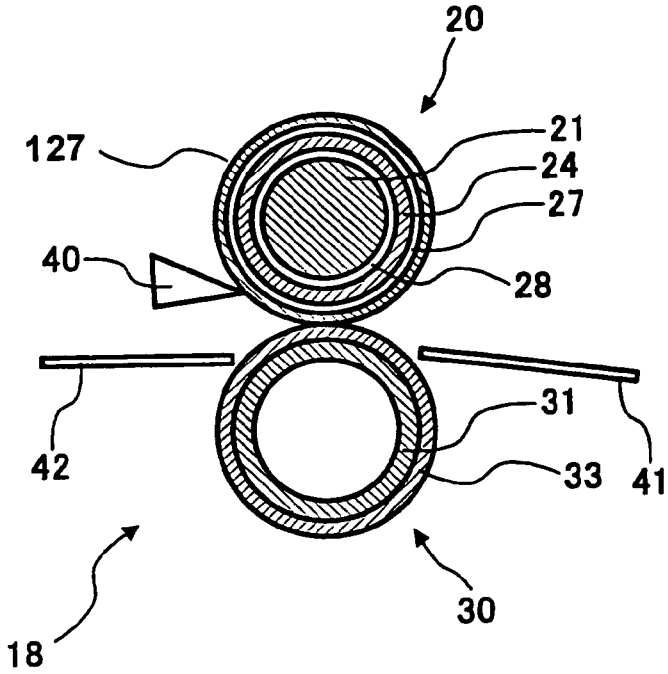
FIG. 9 shows a modified form of a fixing device of the present invention.

A layer (e.g. layer 126 in FIG. 8 and layer 127 in FIG. 9) higher in thermal conductivity than the rigid heat-insulating layer 33 or 24 may be positioned outward of the layer 33 or 24 so as to scatter heat for thereby obviating irregular fixation, i.e., promoting uniform, stable fixation. Also, a layer (e.g. layer 126 in FIG. 8 and layer 127 in FIG. 9) higher in parting ability as to toner than the heat-insulating layer 33 or 24 may be formed to obviate offset and defective sheet separation. Further, a layer (e.g. layer 126 in FIG. 8 and layer 127 in FIG. 9) higher in electric resistance than the heat-insulating layer 33 or 24 may be formed to protect the toner image from disturbance ascribable to discharge before fixation. In addition, a layer (e.g. layer 126 in FIG. 8 and layer 127 in FIG. 9) lower in void content than the heat-insulating layer 33 or 24 may be formed to increase thermal conductivity and scatter heat, thereby insuring uniform, stable fixation. The layer with high parting ability may be formed by use of a material containing fluorocarbon resin or silicone oil.

The heat-insulating layer 24 of the heat roller 20 shown in FIG. 2 or 3 is implemented as a hollow structural body formed of resin, i.e., a structural body with voids and formed of resin having low thermal conductivity, a foam member formed of resin, heat-insulating ceramics, or heat-insulating concrete. As for concrete, there is used heat-insulating concrete caused to finely form by hydrogen gas and generally applied to a fireproof safe, heat-insulating compound concrete for a building, or heat-insulating concrete for a nuclear reactor. In any case, concrete for the heat-insulating layer 24 should be rigid and strong and should have a high void content so as to transfer heat little. With this configuration, the heat-insulating layer 24 can effectively insulate heat while achieving rigidity.

Figure 4:
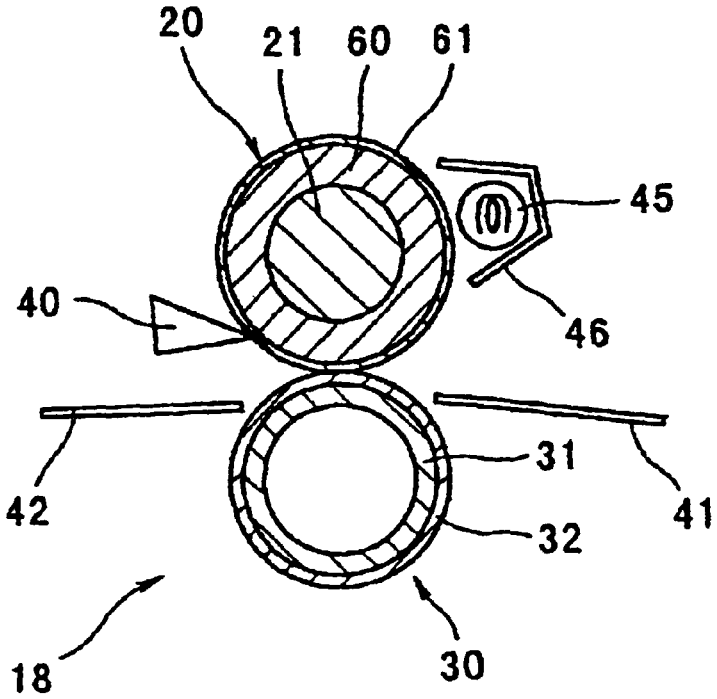
FIG. 4 shows another modified form of the heat-generating body.
Figure 7:
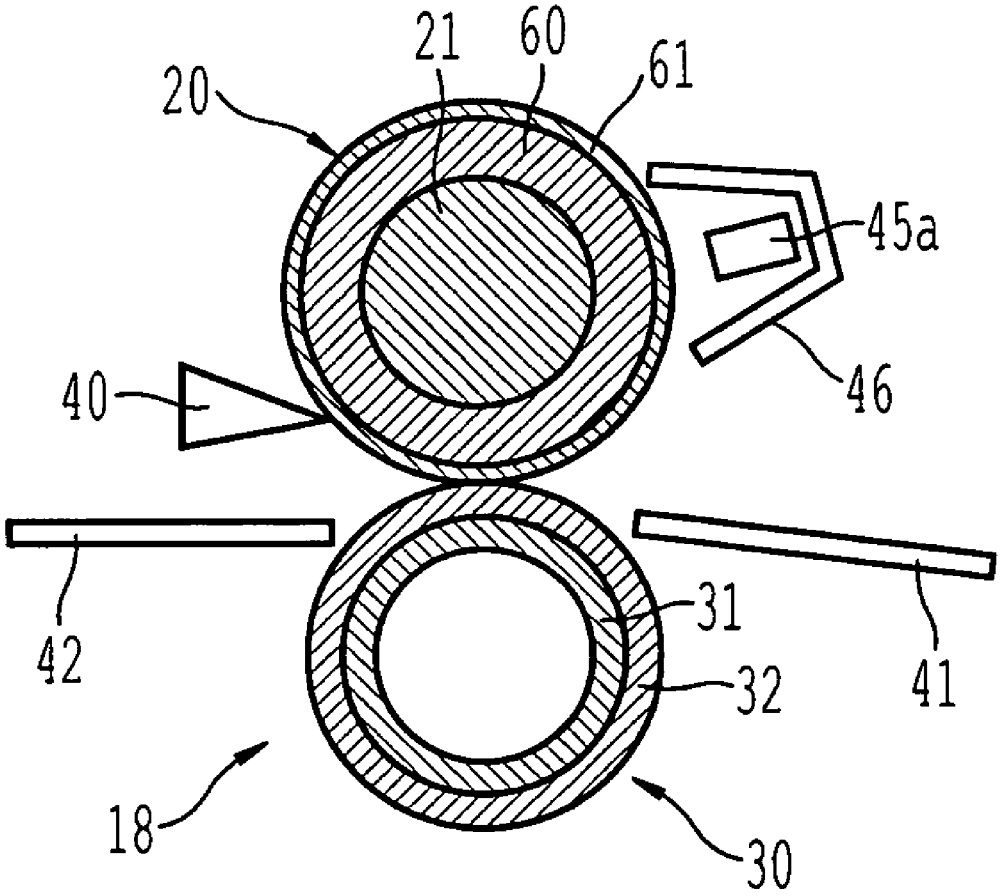
FIG. 7 shows another modified form of the heat-generating body.

FIG. 4 shows another modification of the heat-generating body of the fixing device 18. As shown, the heat-generating body of the heat roller 20 comprises a heater 45 positioned outside of the heat roller 20 for applying radiant heat to the surface of the heat roller 20. A reflector 46 is configured to reflect radiant heat from the heater 45 toward the surface of the heat roller 20. For the heater 45, use may be made of a laser 45*a*, as depicted in FIG. 7. By indirectly heating the sheet with a laser beam, it is possible to obviate an irregular temperature distribution that would render fixation defective.

In FIG. 4, the heat roller 20 is provided with an elastic heat-insulating layer 60 formed on the solid core 21 and a flexible layer 61 formed on the heat-insulating layer 60. The flexible layer 61 may have its surface colored dark or black so as to efficiently absorb radiant heat. Alternatively, the surface of the flexible layer 61 may be colored bluish in consideration of the fact that light to issue from a radiant heat source generally mainly contains a red or an infrared component. For example, a 20 μm to 100 μm thick, thermic rays absorbing member may be prepared by mixing powder of carbon black, graphite, iron black ($Fe_3O_4$), various kinds of ferrite or a compound thereof or powder of copper oxide, cobalt oxide or Indian red ($Fe_2O_3$) with polyamide, polyimide or similar resin binder. The thermic rays absorbing member is then sintered or coated on the surface of the heat-insulating body 60.

The press roller 30 includes a rigid heat-insulating layer 32 formed on the hollow, cylindrical metallic core 31. The heat-insulating layer 32 is formed in the same manner as the heat-insulating layer 24 of the heat roller 20. The core 31 may, of course, be solid, if desired.

Figure 5:
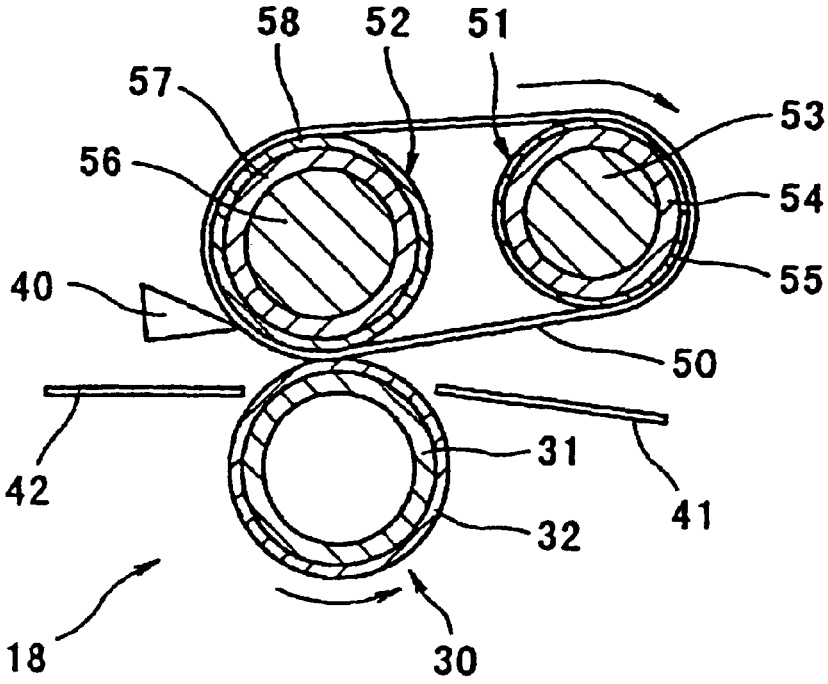
FIG. 5 is a view showing an alternative embodiment of the present invention.

Reference will be made to FIG. 5 for describing an alternative embodiment of the present invention. As shown, the fixing device 18 includes an endless belt or rotatable heating member 50 passed over a heat roller 51 and a press roller 52. The belt 50 and press roller 30, which rotate in directions indicated by arrows in FIG. 5, convey a sheet while nipping it therebetween, thereby fixing a toner image on the sheet with heat and pressure.

The belt 50 is formed of nickel, polyimide or similar heat-resistant resin, carbon steel, stainless steel or similar material whose thermal capacity can be easily reduced. A silicone rubber layer is formed on the surface of the belt 50 and provided with rubber hardness of 25 degrees to 65 degrees in JIS A scale and thickness of 100 μm to 300 μm.

The heat roller 51 is made up of a solid metallic core 53, a heat-resistant insulating member 54 formed on the core 53, and a planar heat-generating member 55 wrapped around the insulating member 54. The insulating member 54 is formed of silicone rubber or similar heat-resistant insulating member and should preferably insulate heat also. The press roller 52, which cooperates with the press roller 30, is made up of a solid metallic core 56, a heat-insulating layer 57 formed on the core 56, and a pressing layer 58 formed on the heat-insulating layer 57. The pressing layer 58 insulates heat and should preferably be provided with rigidity. The press roller 30 is identical in configuration with the press roller 30 of FIG. 4.

In the fixing device 18 shown in FIG. 4 or 5, the heat roller 20 or the belt 50, serving as a rotatable heating member, and the press roller 30 or similar rotatable pressing member cooperate to convey a sheet while fixing a toner image on the sheet. In this type of fixing device 18, the peeler or separating member 40, upstream guide plate 41 and downstream guide plate 42 each are provided with a rigid heat-insulating layer and formed with, e.g., highly heat-resistant polyimide to have a porous structure. Such a heat-insulating layer obviates heat radiation via the sheet and therefore promotes efficient use of heat, thereby saving energy and accelerating the warm-up of the fixing device 18. In addition, the heat-insulating layer obviates toner filming and adhesion by protecting members other than the fixing device 18 from temperature elevation and prevents a developer from being deteriorated.

Figure 6:
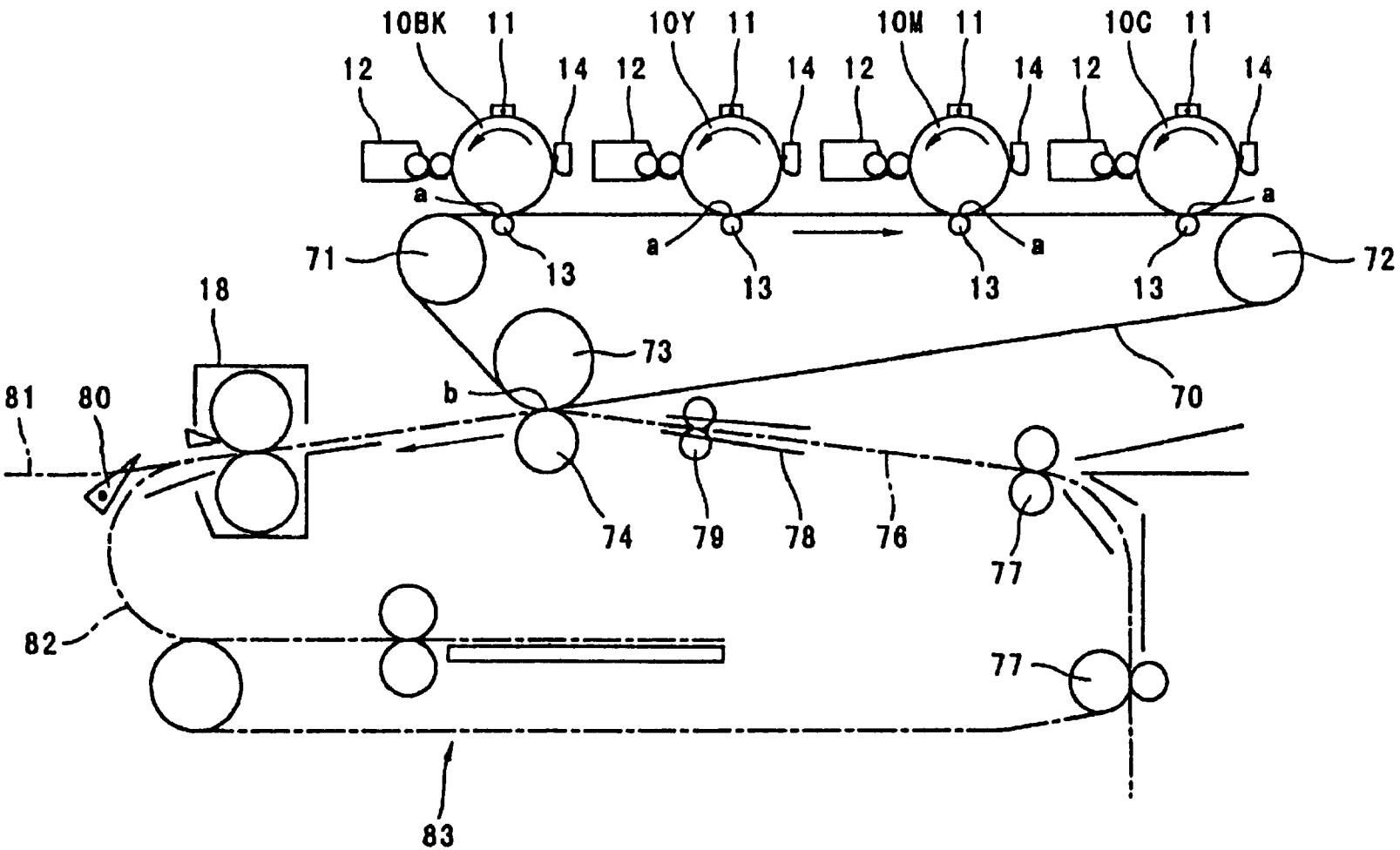
FIG. 6 shows the general construction of a tandem, electrophotographic color image forming apparatus to which the present invention is also applicable.

FIG. 6 shows essential part of a tandem, electrophotographic color image forming apparatus to which the present invention is similarly applicable. As shown, the image forming apparatus includes four drums or image carriers 10BK (black), 10Y (yellow), 10M (magenta) and 10C (cyan) arranged side by side in the horizontal direction at preselected intervals. The drums 10BK through 10C are rotatable counterclockwise each, as viewed in FIG. 6. The charger 11, developing device 11, image transferring device 13, primary cleaning device 14 and so forth are arranged around each of the drums 10BK through 10C.

An endless, intermediate image transfer belt or body 70 is passed over three rollers 71, 72 and 73 below the drums 10BK through 10C and movable clockwise, as viewed in FIG. 6. The intermediate image transfer belt (simply belt hereinafter) 70 is formed of a flexible or an elastic material. Horizontal part of the belt 70 between the rollers 71 and 72 extends via nips between the drums 10BK through 10C and the image transferring devices 13. A secondary image transferring device 74 faces the roller 73 with the intermediary of the belt 70. A secondary cleaning device, not shown, faces the roller 71 with the intermediary of the belt 70.

A path 76 extends below the belt 70 for conveying a sheet from the right to the left as viewed in FIG. 6. Two roller pairs 77, a pair of guide plates 78, a registration roller pair 79, the secondary image transferring device 74, the fixing device 18 and a peeler 80 are sequentially arranged on the path 76 in this order, as named from the right to the left in FIG. 6. A refeed path 83 for a duplex print mode branches off an outlet path 81 downstream of the fixing device 18 and returns to a position upstream of the roller pair 77. A refeeding device 83 is arranged on the refeed path 83.

In operation, to form a color image on a paper, OHP film or similar sheet, a toner image of a particular color is formed on each of the drums 10BK through 10C being rotated counterclockwise, as viewed in FIG. 6. The primary image transferring devices 13 sequentially transfer such toner images of different colors from the drums 10BK through 10C to the belt 70 one above the other at respective image transfer positions a. As a result, a composite color image is completed on the belt 70.

A sheet paid out from a sheet cassette, not shown, is conveyed along the path 76 by the roller pair 77 while being guided by the guide plates 78 until it abuts against the registration roller pair 79. The registration roller pair 79 starts conveying the sheet in synchronism with the movement of the belt 70 carrying the composite color image thereon. The secondary image transferring device 74 transfers the composite color image from the belt 70 to the sheet at a secondary image transfer position b. Subsequently, the sheet with the color image is conveyed to the fixing device 18 along the path 76 and has the color image fixed thereon thereby. The sheet coming out of the fixing device 18 is driven out to a tray, not shown, via the outlet path 81.

In a duplex print mode for forming images on both sides of a sheet, the sheet coming out of the fixing device 18 and carrying the color image on its one side is steered to the refeed path 82 by a path selector 80. The refeeding device 83 turns the sheet and again feeds it toward the secondary image transfer position b via the path 76. At the secondary image transfer position b, the next composite toner image formed on the belt 70 is transferred to the other side of the same sheet, thereby completing a duplex print. The duplex print is driven out of the apparatus via the fixing device 18 and outlet path 81.

The belt 70 is also provided with a heat-insulating layer in order to save energy for fixation and accelerate the warm-up of the fixing device 18. Further, the heat-insulating layer protects members other than the fixing device 18 from temperature elevation for thereby extending the life of the members and stabilizing performance, while achieving the other advantages stated earlier as well.

Various modifications will become possible for those skilled in the art after receiving the teachings of the present disclosure without departing from the scope thereof.

What is claimed is:

1. A fixing device for fixing a toner image on a sheet with heat while conveying said sheet, said fixing device comprising:

a heat roller comprising a heat-generating layer and a rigid heat-insulating layer positioned inward of said heat-generating layer; and a rotary pressing member configured to convey the sheet by nipping said sheet in cooperation with said heat roller, wherein said rigid heat-insulating layer has hardness of 70 or above in JIS (Japanese Industrial Standards) A scale.

2. The fixing device as claimed in claim 1, wherein a rigid member lower in heat-insulating ability, but higher in rigidity, than said rigid heat-insulating layer is positioned inward of said rigid heat-insulating layer.

3. The fixing device as claimed in claim 2, wherein a layer higher in parting ability as to toner than said rigid heat-insulating layer is positioned outward of said rigid heat-insulating layer.

4. The fixing device as claimed in claim 2, wherein said heat-generating layer of said heat roller comprises a planar heat-generating member.

5. The fixing device as claimed in claim 2, wherein said heat roller includes a rigid core.

6. The fixing device as claimed in claim 2, wherein said pressing member comprises at least one of an elastic layer and a flexible layer formed on a surface thereof.

7. The fixing device as claimed in claim 1, wherein a layer higher in thermal conductivity than said rigid heat-insulating layer is positioned outward of said rigid heat-insulating layer.

8. The fixing device as claimed in claim 1, wherein a layer lower in void content than said rigid heat-insulating layer is positioned outward of said rigid heat-insulating layer.

9. The fixing device as claimed in claim 1, wherein said rigid heat-insulating layer has a hollow structure formed of resin.

10. The fixing device as claimed in claim 1, wherein said rigid heat-insulating layer comprises a foam member of resin.

11. The fixing device as claimed in claim 1, wherein said rigid heat-insulating layer is formed of heat-resistant ceramics.

12. The fixing device as claimed in claim 1, wherein said rigid heat-insulating layer is formed of heat-resistant concrete.

13. The fixing device as claimed in claim 1, wherein said rigid heat-generating layer of said heat roller comprises an electromagnetic induction heat-generating member.

14. The fixing device as claimed in claim 13, wherein said rigid heat-insulating layer is positioned between said electromagnetic induction type of heat-generating member and an electromagnetic induction coil.

15. The fixing device as claimed in claim 1, further comprising sheet guides configured to guide the sheet and each comprising a rigid heat-insulating layer.

16. A fixing device for fixing a toner image on a sheet with heat while conveying said sheet, said fixing device comprising:

a heat roller comprising a heat-generating layer and a rigid heat-insulating layer positioned inward of said heat-generating layer; and a rotary pressing member configured to convey the sheet by nipping said sheet in cooperation with said heat roller, wherein said rigid heat-insulating layer deforms, when subject to pressure of 1 $kg/cm^2$ to 5 $kg/cm^2$, by not more than 10% in a direction in which said pressure is applied.

17. A fixing device for fixing a toner image on a sheet with heat while conveying said sheet, said fixing device comprising:

a heat roller comprising a heat-generating layer and a rigid heat-insulating layer positioned inward of said heat-generating layer; and a rotary pressing member configured to convey the sheet by nipping said sheet in cooperation with said heat roller, wherein said rigid heat-insulating layer has thermal conductivity of 0.1 W/m·k or below, as measured at a position and in a condition wherein said heat roller and said pressing member nip the sheet.

18. A fixing device for fixing a toner image on a sheet with heat while conveying said sheet, said fixing device comprising:

a heat roller comprising a heat-generating layer and a rigid heat-insulating layer positioned outward of said heat-generating layer; and a rotary pressing member configured to convey the sheet by nipping said sheet in cooperation with said heat roller, wherein said rigid heat-insulating layer has hardness of 70 or above in JIS (Japanese Industrial Standards) A scale.

19. A fixing device for fixing a toner image on a sheet with heat while conveying said sheet, said fixing device comprising:

a heat roller comprising a heat-generating layer and a rigid heat-insulating layer positioned outward of said heat-generating layer; and a rotary pressing member configured to convey the sheet by nipping said sheet in cooperation with said heat roller, wherein said rigid heat-insulating layer deforms, when subject to pressure of 1 $kg/cm^2$ to 5 $kg/cm^2$, by less than 10% in a direction in which said pressure is applied.

20. A fixing device for fixing a toner image on a sheet with heat while conveying said sheet, said fixing device comprising:

a heat roller comprising a heat-generating layer and a rigid heat-insulating layer positioned outward of said heat-generating layer; and a rotary pressing member configured to convey the sheet by nipping said sheet in cooperation with said heat roller, wherein said rigid heat-insulating layer has thermal conductivity of 0.1 W/m·k or below, as measured at a position and in a condition wherein said heat roller and said pressing member nip the sheet.

21. A fixing device for fixing a toner image on a sheet with heat while conveying said sheet, said fixing device comprising:

a heat roller comprising a heat-generating layer and a rigid heat-insulating layer positioned outward of said heat-generating layer; and a rotary pressing member configured to convey the sheet by nipping said sheet in cooperation with said heat roller, wherein said rigid heat-insulating layer is formed of heat-resistant concrete.

22. In an image forming apparatus for transferring a toner image from an image carrier to an intermediate image transfer body, transferring said toner from said intermediate image transfer body to a sheet and fixing said toner image on said sheet by a fixing device, said fixing device comprises a heat roller comprising a heat-generating layer and a rigid heat-insulating layer positioned inward of said heat-generating layer, and a rotary pressing member configured to convey the sheet by nipping said sheet in cooperation with said heat roller, wherein a rigid member lower in heat-insulating ability, but higher in rigidity, than said rigid heat-insulating layer is positioned inward of said rigid heat-insulating layer, wherein said rigid heat-insulating layer has hardness of 70 or above in JIS (Japanese Industrial Standards) A scale.

23. An image forming apparatus as claimed in claim 22, wherein said pressing member comprises at least one of an elastic layer and a flexible layer formed on a surface thereof.

24. An image forming apparatus as claimed in claim 22, wherein said intermediate transfer body comprises a heat-insulating layer.

25. An image forming apparatus as claimed in claim 22, wherein said intermediate image transfer body comprises a belt.

26. The fixing device as claimed in claim 2, further comprising sheet guides configured to guide the sheet and each comprising a rigid heat-insulating layer.

* * * * *